US007959255B2

(12) United States Patent
Kubo

(10) Patent No.: US 7,959,255 B2
(45) Date of Patent: Jun. 14, 2011

(54) LIQUID DROPLET JETTING APPARATUS

(75) Inventor: Tomoyuki Kubo, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 322 days.

(21) Appl. No.: 12/119,790

(22) Filed: May 13, 2008

(65) Prior Publication Data

US 2008/0284815 A1 Nov. 20, 2008

(30) Foreign Application Priority Data

May 14, 2007 (JP) ..... 2007-128394

(51) Int. Cl.
*B41J 2/165* (2006.01)

(52) U.S. Cl. ..... 347/30; 347/29; 347/31; 347/32; 347/33; 347/34; 347/35; 347/36

(58) Field of Classification Search ..... 347/1–109
See application file for complete search history.

(56) References Cited

U.S. PATENT DOCUMENTS

| | | | | |
|---|---|---|---|---|
| 574,141 | A | 12/1896 | Davis et al. | |
| 3,854,399 | A | 12/1974 | Keur et al. | |
| 4,369,450 | A | 1/1983 | Iwagami et al. | |
| 4,380,771 | A * | 4/1983 | Takatori | 347/43 |
| 5,570,116 | A * | 10/1996 | Soga | 347/30 |
| 6,062,671 | A * | 5/2000 | Kanda et al. | 347/30 |
| 6,155,666 | A * | 12/2000 | Sugimoto et al. | 347/24 |
| 7,188,922 | B2 | 3/2007 | Kubo | |
| 7,294,952 | B2 | 11/2007 | Ito | |
| 2007/0229584 | A1 * | 10/2007 | Hirato | 347/30 |

FOREIGN PATENT DOCUMENTS

| | | | |
|---|---|---|---|
| JP | 621833 | B2 | 1/1987 |
| JP | 1242257 | B2 | 9/1989 |
| JP | 10000765 | A | 1/1998 |
| JP | 2000255083 | A | 9/2000 |
| JP | 2004291342 | A | 10/2004 |
| JP | 2005322850 | A | 11/2005 |

* cited by examiner

*Primary Examiner* — Ryan Lepisto
*Assistant Examiner* — Guy G Anderson
(74) *Attorney, Agent, or Firm* — Baker Botts L.L.P.

(57) ABSTRACT

A liquid droplet jetting apparatus includes a jetting head unit which has a nozzle which jets droplets of a liquid, and a heat generating section, a suction port which is formed in the jetting head unit, and which opens near the nozzle, and a suction device which sucks air around the nozzle from the suction port, and cools down the heat generating section of the jetting head unit by the air which is sucked. Since the heat generating portion is cooled down by the air sucked from the suction port by the suction device, it is possible to reduce a possibility of the heat of the heat generating section being transferred to the jetting head unit, and destabilizing an operation of the jetting head unit. Moreover, since the suction port opens near the nozzle, it is possible to suck fine liquid droplets together with air around the nozzle.

19 Claims, 7 Drawing Sheets

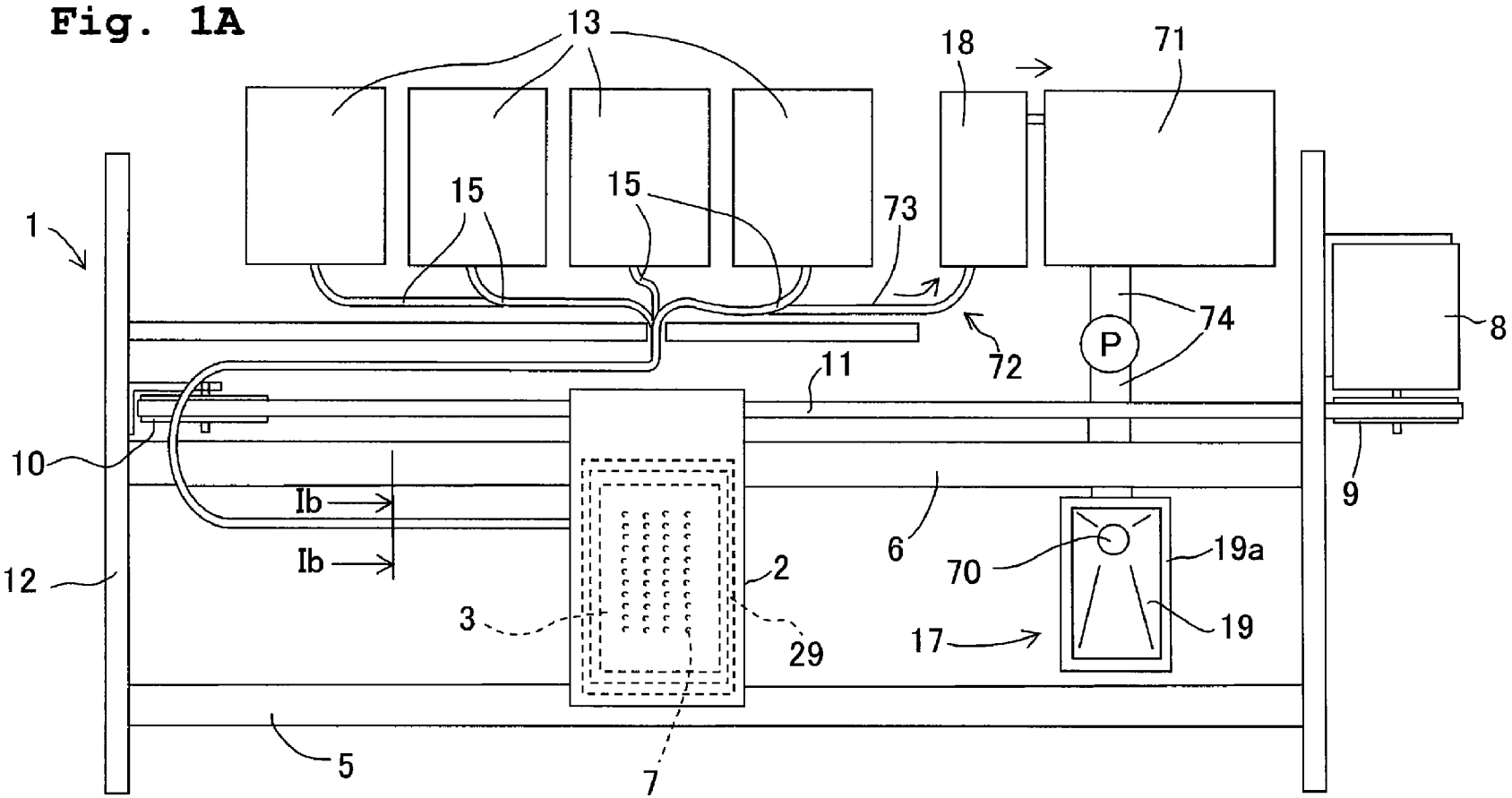
Fig. 1A
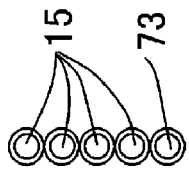
Fig. 1B
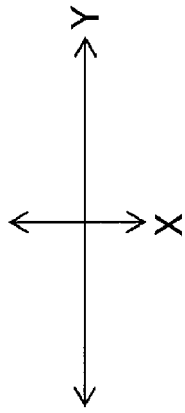

LIQUID DROPLET JETTING APPARATUS

CROSS REFERENCE TO RELATED APPLICATION

The present application claims priority from Japanese Patent Application No. 2007-128394, filed on May 14, 2007, the disclosure of which is incorporated herein by reference in its entirety.

BACKGROUND OF THE INVENTION

1. Field of the Invention

The present invention relates to a liquid droplet jetting apparatus which includes a jetting head unit for jetting liquid droplets, and particularly to a cooling structure of a heat generating section of the liquid droplet jetting apparatus, and a structure which eliminates floating of fine liquid droplets (mist) which are generated when the liquid droplets are jetted from a nozzle.

2. Description of the Related Art

In a liquid droplet jetting apparatus such as an ink-jet recording apparatus, if there is a portion which generates heat at the time of jetting a liquid, the generated heat affects and destabilizes the jetting operation. Therefore, in U.S. Pat. No. 7,188,922 (corresponds to Japanese Patent Application Laid-open No. 2004-291342), a recording apparatus as a liquid droplet jetting apparatus, in which a heat sink is arranged being in contact with a driving circuit element (driver element) which generates a heat, has been described.

In Japanese Patent No. 2738697 (refer to FIG. 1 and FIG. 2), a liquid jetting head, which jets liquid upon bubbling by heat generation and in which a liquid is used for cooling down a heat generating substrate of a head, has been described. More elaborately, the entire head and the heat generating substrate are forcibly cooled down by flowing a liquid such as water in a liquid supply pipe in the form of a tube provided around the head, or in a hole provided in the heat generating substrate. Moreover, a structure, in which the heat generating substrate is formed of a porous member, and a liquid is allowed to be permeated in the porous member, and the heat is released by the heat of vaporization, has been described.

Moreover, in liquid droplet jetting apparatuses, it has hitherto been known that fine liquid droplets (mist) are generated at the time of jetting liquid droplets from a nozzle, and these fine liquid droplets contaminate an inside of the apparatus. In Japanese Patent Application Laid-open No. 10-765, a structure which recovers these fine liquid droplets (mist) has been described. Concretely, a recording head which jets an ink is installable, and a carriage which is reciprocatably movable, and a separating member for forming a channel for air which flows along with the movement of the carriage are provided in this liquid droplet jetting apparatus. Moreover, a filter which is capable of absorbing the ink in the air channel is provided. An air flow is generated inside the apparatus due to the movement of the carriage, and ink mist in the air flow is recovered by a filter.

In recording apparatuses, in recent years, high densification and high speeding-up of recording have been sought, and there is a tendency toward an increase in the number of nozzles which jet a liquid. When the recording is carried out at a high speed, in other words, when a liquid is jetted from a large number of nozzles at a high frequency, there is an increase in an amount of heat generated by a driving circuit element. The heat of the circuit element is transferred to the jetting head, and there is a possibility that the jetting operation is destabilized.

SUMMARY OF THE INVENTION

An object of the present invention is to solve the above-mentioned problems, and to improve a heat releasing effect in a heat generating section of a liquid droplet jetting apparatus, and also to recover fine liquid droplets (mist) which float in the apparatus.

According to a first aspect of the present invention, there is provided a liquid droplet jetting apparatus which jets droplets of a liquid including: a jetting head unit having a nozzle which jets the liquid droplet, and a heat generating section in the jetting head unit; a suction port which is formed in the jetting head unit, and which is open in the vicinity of the nozzle; and a suction device which sucks air around the nozzle from the suction port to cool the heat generating section of the jetting head unit by the sucked air.

According to the liquid droplet jetting apparatus of the present invention, since the heat generating section is cooled down by the air which is sucked from the suction port by the suction device, it is possible to reduce a possibility that the heat of the heat generating section is transferred to the jetting head unit, and that an operation of the jetting head unit is destabilized. Moreover, since the suction port opens in the vicinity of the nozzle, it is possible to suck fine liquid droplets, which are jetted from the nozzle and which float without landing on an object subjected to jetting, together with the air around the nozzle. Accordingly, it is possible not only to cool down the heat generating section, but also to reduce a contamination due to adhering of the fine liquid droplets at an interior of the apparatus.

In the liquid droplet jetting apparatus of the present invention, the suction port may be continuously open around the nozzle.

The liquid droplet jetting apparatus of the present invention may further include: a waste liquid tank which stores the liquid discharged from the jetting head unit for restoring a jetting function of the jetting head unit; and a conduit which connects the jetting head unit and the waste liquid tank via the suction device, and which guides the air, sucked from the suction port, to the waste liquid tank. In this case, since the fine liquid droplets, which are jetted from the nozzle and float without landing on the object, are sucked from the suction port together with the air around the nozzle, and stored upon being guided to the waste liquid tank through the conduit, it is possible to prevent the fine liquid droplets from adhering to the interior of the apparatus.

The liquid droplet jetting apparatus of the present invention may further include a maintenance unit having the waste liquid tank, a cap which covers the nozzle, a suction pump which sucks the liquid from the nozzle, and a tube which connects the cap and the waste liquid tank via the suction pump. The suction device may use the suction pump to suck the air around the nozzle from the suction port. In this case, since a pump and a filter etc. for recovering the mist is not required to be provided separately, it is not necessary to secure an arrangement space, and it is possible to make the liquid droplet jetting apparatus even smaller. Moreover, since it is possible to reduce the number of components, this leads to a reduction in a manufacturing cost of the liquid droplet jetting apparatus.

In the liquid droplet jetting apparatus of the present invention, the jetting head unit may be provided with a jetting head having the nozzle which jets the liquid droplet, a wire member on which a circuit element for driving the jetting head is mounted, and a heat releasing body which releases heat of the circuit element; and the heat releasing body may be arranged to be in contact with the air sucked from the suction port. The heat generating section may be the circuit element; and the heat releasing body may be in a thermally conductive contact with the circuit element. According to such structure, the heat of the circuit element is transferred to the heat releasing body, and the heat releasing body continues to be cooled down by being in contact with the air sucked from the suction port. Therefore, the heat of the circuit element is removed by the heat releasing body, and a rise in temperature of the circuit element is suppressed. Therefore, it is possible to maintain the jetting operation to be stable.

In the liquid droplet jetting apparatus of the present invention, an insulation treatment may be applied to the circuit element and a surface of the wire member. In this case, it is possible to prevent an electrical fault which may be caused due to adhering of the fine liquid droplets sucked together with the air around the nozzle to the circuit element and the wire member.

In the liquid droplet jetting apparatus of the present invention, the jetting head unit may be provided to be movable in a predetermined direction along an object onto which the liquid droplet is to be jetted; the waste liquid tank may be supported by a body of the liquid droplet jetting apparatus, the body movably supporting the jetting head unit; and at least a part of the conduit may be a flexible tube. In this case, since the tube bends in accordance with the movement of the jetting head unit, there is no possibility that a flow of air in the conduit is disturbed even when the jetting head unit moves.

In the liquid droplet jetting apparatus of the present invention, the nozzle may be formed as a plurality of nozzles arranged in an orthogonal direction orthogonal to the predetermined direction; the plurality of nozzles may form a nozzle row; and the suction port may be formed to extend in the orthogonal direction, with respect to the nozzle row, on both sides of the predetermined direction. Moreover, the suction port may be formed as a plurality of suction ports arranged in the orthogonal direction, with respect to the nozzle row, on both sides of the predetermined direction.

In the liquid droplet jetting apparatus of the present invention, a cartridge, which accommodates the liquid to be supplied to the jetting head unit, may be supported by the body of the liquid droplet jetting apparatus; the jetting head unit and the cartridge may be connected by a liquid supply tube which is a flexible tube; and the flexible tube may be arranged substantially in parallel to the liquid supply tube. In this case, it is possible to arrange the tube which forms the conduit, along the liquid supply tube, and to tie up the flexible tube and the liquid supply tube. Therefore, it is possible to arrange tidily, a large number of tubes at an interior of the apparatus.

In the liquid droplet jetting apparatus of the present invention, the jetting head unit may further be provided with a casing which supports the jetting head and the heat releasing body; the suction port may be formed in the casing; and the suction device may negatively pressurize a space inside the casing including a surrounding of the heat releasing body to suck, from the suction port, the air outside the casing. In this case, by negatively pressurizing the space inside the casing, the air which includes the mist is sucked promptly into the casing from the suction port, and the air around the heat releasing body is replaced. Therefore, recovery of the mist and heat release from the circuit element is carried out efficiently.

The liquid droplet jetting apparatus of the present invention may further include: a conduit having one end formed in the vicinity of the nozzle as the suction port, and the other end connected to the suction device, and a part of the conduit may be in thermally conductive contact with the heat releasing body. In this case, since the air which contains the mist sucked from the suction port moves inside the conduit which is in contact with the heat releasing body, the heat releasing body is cooled. Therefore, the air which includes the mist does not come in contact with the circuit element, and it is possible to avoid an electrical fault due to the mist.

In the liquid droplet jetting apparatus of the present invention, the jetting head unit may further be provided with a casing which supports the jetting head and the heat releasing body; the suction port may be formed in the casing; a space may be defined between the heat releasing body and a wall of the casing, the space being connected to the suction port; and the air may be sucked while contacting the heat releasing body. In this case, since the air in the space which is formed adjacent to the heat releasing body is replaced assuredly, the heat of the circuit element is released efficiently via the heat releasing body. Moreover, since the air which contains the mist does not make a contact with the circuit element, it is possible to avoid an electrical fault due to the mist.

In the liquid droplet jetting apparatus of the present invention, a space may be defined inside the heat releasing body, one end of the space communicating with the suction port and the other end of the space communicating with the suction device. In this case, since the air at an interior of the heat releasing body is replaced assuredly, the heat of the circuit element is released efficiently via the heat releasing body. Moreover, since the air which contains the mist does not make a contact with the circuit element, it is possible to avoid an electrical fault due to the mist.

According to a second aspect of the present invention, there is provided a liquid droplet jetting apparatus which jets droplets of a liquid, including: a jetting head unit having a nozzle which jets the liquid droplet, and which is movable in a predetermined direction; a suction port which is formed in the jetting head unit, and which is open in the vicinity of the nozzle; and a suction device which sucks, from the suction port, mist generated when the nozzle jets the liquid droplet.

According to the liquid droplet jetting apparatus of the present invention, since the suction port opens in the vicinity of the nozzle, it is possible to suck the mist, which is generated when the liquid droplets are jetted from the nozzle, together with the air around the nozzle. Therefore, it is possible to reduce a contamination due to adhering of the mist at the interior of the apparatus.

In the liquid droplet jetting apparatus of the present invention, the suction port may be continuously open around the nozzle. In this case, it is possible to suck efficiently the mist, which is generated when the liquid droplets are jetted from the nozzle, together with the air around the nozzle.

In the liquid droplet jetting apparatus of the present invention, the nozzle may be formed as a plurality of nozzles arranged in an orthogonal direction orthogonal to the predetermined direction; the plurality of nozzles may form a nozzle row; and the suction port may be formed to extend in the orthogonal direction, with respect to the nozzle row, on both sides of the predetermined direction, and the suction port may be formed as a plurality of suction ports arranged in the orthogonal direction, with respect to the nozzle row, on both sides of the predetermined direction. When the jetting head unit jets the liquid droplets while moving in a predetermined direction, the mist tends to flow toward a side opposite to the movement direction of the jetting head unit due to an air flow which is generated by the movement of the jetting head unit. According to the liquid droplet jetting apparatus of the present invention, since the suction port opens on both sides of the movement direction of the jetting head unit with respect to the nozzle row, it is possible to recover the mist efficiently.

BRIEF DESCRIPTION OF THE DRAWINGS

FIG. 1A is a schematic plan view of a recording apparatus as a liquid droplet jetting apparatus of the present invention, and FIG. 1B is a cross-sectional view taken along a line Ib-Ib in FIG. 1A;

DETAILED DESCRIPTION OF THE PREFERRED EMBODIMENTS

Figure 2:
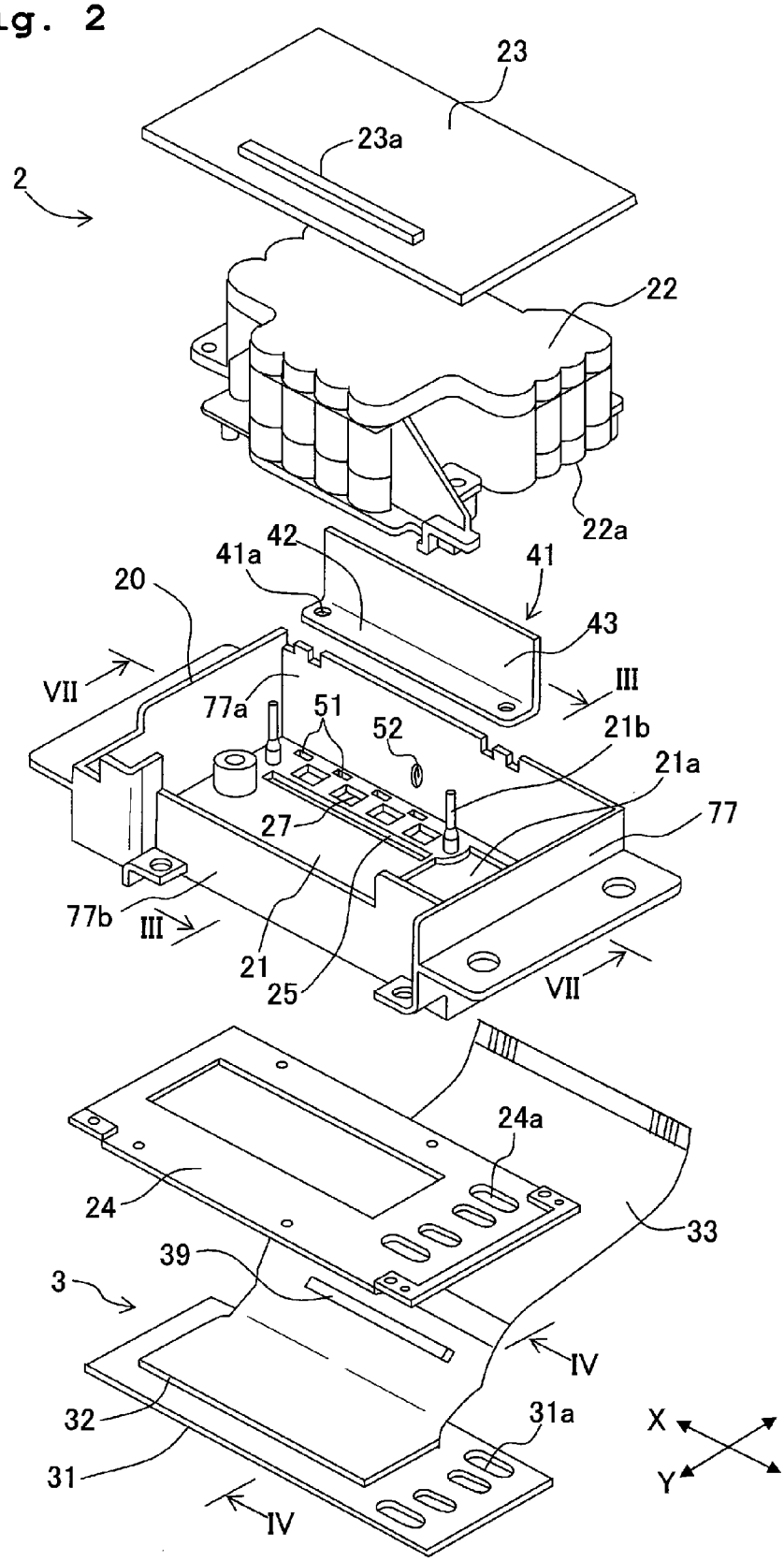
FIG. 2 is an exploded perspective view of a jetting head unit of the recording apparatus.

Basic embodiments of the present invention will be described below. FIG. 1A is a schematic plan view of a recording apparatus 1 as a liquid droplet jetting apparatus of the present invention. The recording apparatus 1 may be applied to an independent printer apparatus or may also be applied to a printer function (recording section) of a multi-function apparatus which is provided with a plurality of functions such as a facsimile function and a copy function.

The recording apparatus 1, as shown in FIG. 1A, is provided with a jetting head unit 2 which forms a carriage. A jetting head 3 is mounted on the jetting head unit 2, with nozzles 7 of the jetting head 3 exposed on a lower surface of the jetting head unit 2. A first guide member 5 and a second guide member 6 are members which movably support the jetting head unit 2 which is the carriage, to be movable in a main scanning direction (Y-axis direction). The jetting head unit 2 reciprocates along the Y-axis direction by a drive pulley 9 which is coupled with a carriage motor 8, and a time belt 11 which is put round a driven pulley 10.

A paper as a recording medium (object subjected to jetting) is transported in a secondary scanning direction (X-axis direction), which is orthogonal to the main scanning direction (Y-axis direction), below the jetting head unit 2.

Replaceable ink cartridges 13 are installed inside an apparatus body 12, and in accordance with the number of ink colors, four ink cartridges 13 for a black ink, a cyan ink, a magenta ink, and a yellow ink are provided. The ink in each of the ink cartridges 13 is provided independently to the jetting head unit 2 via a supply tube. Here, an ink supply tube (liquid supply tube) 15 made of a resin which is flexible is used as the supply tube.

As shown in FIG. 1A, a maintenance unit 17 is provided inside the apparatus body 12 of the recording apparatus 1, at one side (right side in FIG. 1A) on an outer side of a width (recording area) of the paper in the Y-axis direction. The maintenance unit 17 is provided corresponding to a stand-by position (home position) of the carriage, and carries out a restoring operation (purging) for restoring a jetting function of the jetting head 3.

The maintenance unit 17, as shown in FIG. 1A, includes a cap 19, a suction pump P, a waste liquid tank 71, and a tube 74 which connects the cap 19 and the waste liquid tank 71 via the suction pump P. The cap 19 is provided to be movable between a position in contact with an opening surface of the nozzles 7, and a position away from this position, along a direction (vertical direction) orthogonal to the movement direction of the carriage, by an ascending and descending mechanism which is not shown in the diagram.

The cap 19 is formed of an elastic material in the form of rubber. A rib 19*a* which projects toward an opening surface of the nozzle 7 is formed in the cap 19 to cover an outer circumference of a nozzle group when the cap 19 makes a contact with the opening surface. By an elastic deformation of the rib 19*a*, the cap 19 makes a close contact with the opening surface. A discharge port 70 is formed at a bottom portion of the cap 19, and the discharge port 70 is connected to the pump P by the tube 74. A pump such as a tube pump can be used as the suction pump P.

In the recovery operation, the cap 19 makes a close contact with the opening surface of the nozzles 7, and the ink is sucked forcibly from the nozzles 7 of the jetting head 3 by a suction force of the suction pump P into an inner side of the cap 19. This ink is discharged from the discharge port 70 of the cap 19, and is stored in the waste liquid tank 71 which is installed in the apparatus body 12. The waste liquid tank 71 has a built-in porous body, and the waste liquid is absorbed and held inside the porous body.

A pump 18 (suction device) is arranged adjacent to the waste liquid tank 71. A conduit 72 is connected to the pump 18, and air around the nozzles 7 is sucked from a suction port 29 (refer to FIG. 1A) which is formed in the jetting head unit 2, and which opens to face the object subjected to jetting. The sucked air is sent to the waste liquid tank 71. At this time, the air is passed through the porous body inside the waste liquid tank 71, and an ink mist contained in the air is captured inside the porous body in the waste liquid tank 71. A blowing fan and a tube pump etc. can be used as the pump 18. In this embodiment, the suction pump P and the pump 18 are provided separately. However, the suction pump P may also serve as the pump 18. In other words, the air around the nozzles 7 may be sucked from the suction port 29 formed in the jetting head unit 2 by using the suction pump P. In this case, the conduit 72 is to be connected to the suction pump P. The air around the nozzles 7 is sucked when the jetting head unit 2 is being driven. In other words, the air around the nozzles 7 is sucked when the recording is being carried out. On the other hand, the jetting function restoring operation of the jetting head 3 as mentioned above is carried out when the jetting head unit 2 is not being driven. In other words, the jetting function restoring operation of the jetting head unit 2 is carried out when the recording is not being carried out. In other words, the pump P is not used at the same time for sucking the air around the nozzles 7 and for the restoring operation of the jetting head 3. Consequently, by switching the destination to the conduit 72 or the tube 74 by a valve etc., it is possible to use the suction pump P for sucking the air around the nozzles 7, and for sucking the ink from the jetting head 3. In this case, since the pump 18 is not required to be provided separately, it is not necessary to secure a space for arranging the pump 18, and it is possible to make a size of the recording apparatus 1 even smaller. Moreover, since it is possible to reduce the number of components, it leads to a reduction in a manufacturing cost. It is possible to achieve a similar effect even when the pump 18 also functions as the suction pump P.

At least a portion between the pump 18 and the jetting head unit 2 of the conduit 72 is formed of a flexible discharge tube (tube forming a conduit) 73 made of a resin. The abovementioned portion of the discharge tube 73 is overlapped in parallel with the plurality of ink supply tubes 15 as shown in FIG. 1B, and is tied up by mutually by an adhesive or a member such as a strap member (not shown in the diagram), in at least locations which bend in accordance with the running of the jetting head unit 2. Accordingly, it is possible to arrange a large number of tubes tidily at the interior of the apparatus body 12.

Figure 3:
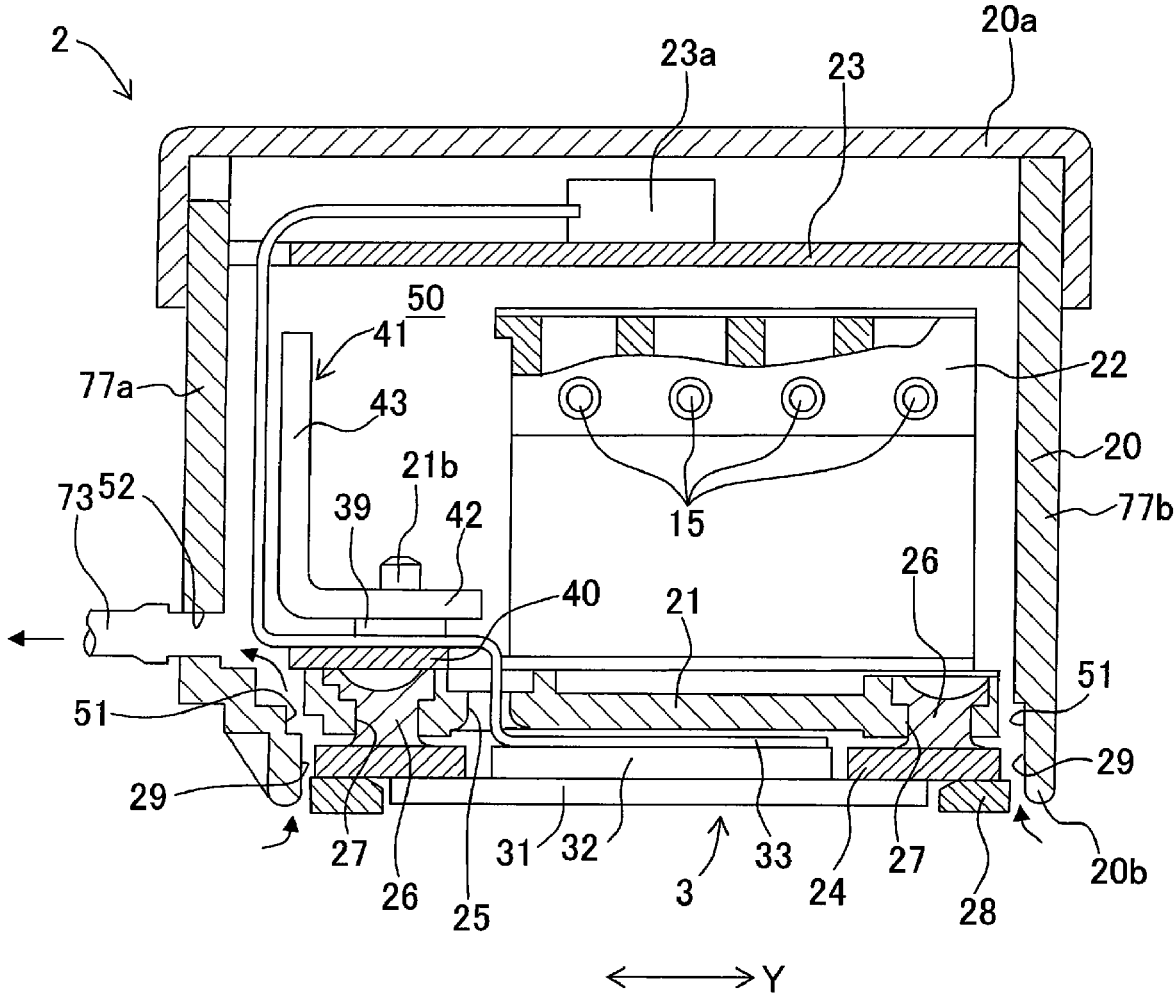
FIG. 3 is a cross-sectional view taken along a line III-III in FIG. 2, in a first embodiment.

The jetting head unit 2, as shown in FIG. 2, is provided with a head holder 20 which is substantially box shaped with an upper surface open, and a lid 20*a* (refer to FIG. 3) covering the upper surface of the head holder 20. The head holder 20 and the lid 20*a* form a casing, and at an interior of the casing, a space 50 which is almost closed except for the suction port 29 which will be described later is formed. By inserting a reinforcing frame 24 on a lower surface side of a bottom plate 21, the jetting head 3 is fixed to the head holder 20. A rib 20*b* which projects toward the recording medium (lower side) is provided on a lower surface of the head holder 20, such that the rib 20*b* surrounds the jetting head 3. In other words, the jetting head 3 is arranged at an inner side of a recess formed on the lower surface side of the bottom plate 21.

For reducing a bump (unevenness) at the lower surface side (surface facing the recording medium) of the head holder 20, a front frame 28 is provided at an inner side of the rib 20*b* such that the front frame 28 surrounds the jetting head 3. The front frame 28 is stuck to a lower surface of the reinforcing frame 24. Between an outer circumference of the front frame 28 and an outer circumference of the jetting head 3, and a lower edge portion 20*a* of the head holder 20, a gap 29 is formed throughout the circumference. This gap 29, as it will be described later, functions as a suction port.

An ink storage portion 22 which temporarily stores the ink supplied from the ink cartridge 13 and a circuit board 23 are mounted on an upper surface side of the bottom plate 21 of the head holder 20. The circuit board 23 receives a driving signal from a control unit (not shown in the diagram) which is installed in the apparatus body 12 via a flexible wiring cable (not shown in the diagram). The circuit board 23 supplies a driving signal to an actuator 32 of the jetting head 3 via a flexible wire member 33 which is connected to a connector 23*a*.

An opening portion 21*a* is formed through the bottom plate 21 of the head holder 20. At an inner side of the opening portion 21*a*, an ink outflow port 22*a* of the ink storage portion 22, and an ink inflow port 31*a* of the jetting head 3 are connected via a connecting hole 24*a* of the reinforcing frame 24. Ink is supplied independently for each color, from the ink storage portion 22 to the jetting head 3.

A slit hole 25 through which, a flexible wire member 33 is inserted is formed through the bottom plate 21, at a position toward one side wall 77*a* of the head holder 20. Moreover, a plurality of through holes 27 for pouring an adhesive for fixing the jetting head 3 on the lower surface side of the bottom plate 21 is formed in the bottom plate 21, along both the walls namely, one side wall 77*a* and the other side wall 77*b* facing the side wall 77*a*. Moreover, two pins 21*b* for positioning and fixing a heat releasing body 41 which will be described later are provided in the bottom plate 21.

Furthermore, a plurality of communicating ports 51 are formed through the bottom plate 21, on an outer side of the through hole 27, in an area between the through hole 27 and the side walls 77*a* and 77*b* respectively. The communication ports 51 communicate the space 50 on an upper side of the bottom plate 21 and inside of the recess on the inner side of the rib 20*b*. A connecting port 52 is formed through the side wall 77*a*, and a discharge tube 73 is connected to an outer side of the connecting port 52, via a connector (refer to FIG. 3). In other words, the conduit 72 which is connected to the pump 18 includes the communicating port 51 and the space 50 inside the head holder 20, and opens around the nozzles 7 with the gap 29 as a suction port. Instead of forming the gap 29, namely the suction port 29, continuously around the nozzle 7, one or a plurality of gaps 29 may be formed on one side of the jetting head 3.

The jetting head 3, similarly as jetting head described in U.S. Pat. No. 7,294,952 (corresponds to Japanese Patent Application Laid-open No. 2005-322850), is formed by stacking a cavity portion 31 which opens the nozzles 7 on a lower surface side, and has a pressure chamber 35 on an upper surface side, a plate actuator 32, and a flexible wire member 33 as shown in FIG. 4.

The cavity portion 31 is formed by stacking a plurality of thin plates, an ink supply channel 34, which distributes the ink entered the ink inflow port 31*a* of the cavity portion 31 from the ink storage portion 22 to the plurality of pressure chambers 35, is formed inside the cavity portion 31.

Figure 4:
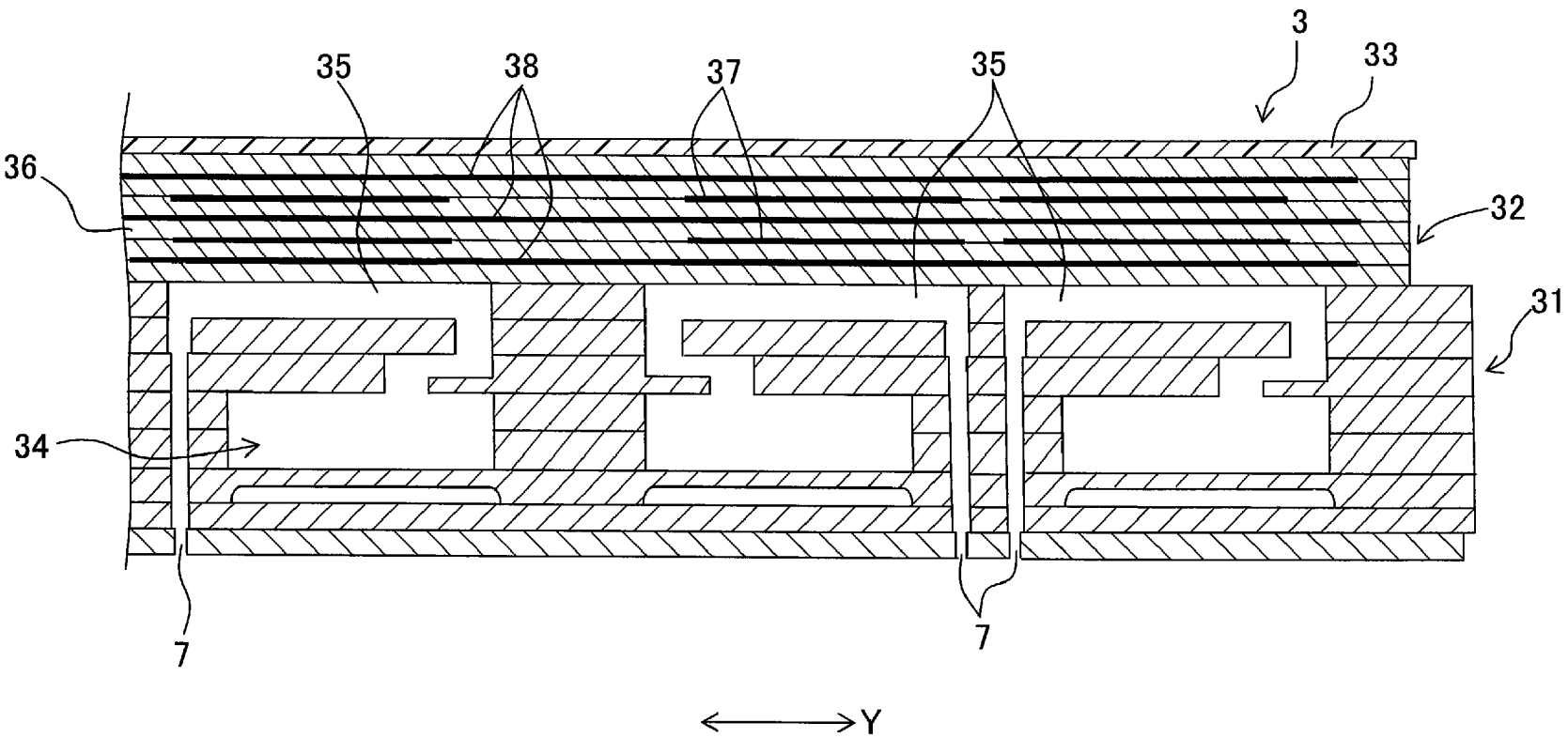
FIG. 4 is a cross-sectional view taken along a line IV-IV in FIG. 2.

The actuator 32, as shown in FIG. 4, is formed by a plurality of ceramics layers 36 which are flat shaped, and have a size spreading over all pressure chambers, and which are stacked in a direction orthogonal to a direction of flatness, and a plurality of electrodes which are arranged between the ceramics layers 36.

The electrodes include an individual electrode 37 which is formed for each pressure chamber 35, and a common electrode 38 which is formed spreading over the plurality of pressure chambers 35, and are arranged alternately between the ceramics layers 36. The individual electrodes 37 in the direction of stacking are connected to be integrated mutually, and drawn on a surface. The common electrodes 38 in the direction of stacking are also connected to be integrated mutually and drawn on a surface. Both the individual electrodes 37 and the common electrodes 38 are connected to a wiring pattern of the flexible wire member 33.

In the actuator 32 provided with the electrodes in such manner, by applying a voltage between the individual electrode 37 and the common electrode 38, a portion of the ceramics layer 36 sandwiched between the individual electrode 37 and the common electrode 38 is elongated, thereby applying a pressure to the ink in the corresponding pressure chamber 35, and it is possible to jet the ink from the nozzle 7.

A circuit element 39 for driving the actuator 32 is mounted at an intermediate portion of the flexible wire member 33. The circuit element 39 converts a driving signal transmitted serially from the circuit board 23 to a parallel signal corresponding to the plurality of individual electrodes 37, and outputs as a voltage suitable for drive of the ceramics layer 36. Consequently, the circuit element 39, at the time of recording, generates heat by outputting the driving signal such that the ink is jetted from the plurality of nozzles with a high frequency.

For releasing the heat of the circuit element 39, the heat releasing body 41 is fixed to the pin 2*b* at the upper surface side of the bottom plate 21. The flexible wire member 33 is drawn to position the circuit element 39 between the bottom plate 21 and the heat releasing body 41, and an elastic member 40 in the form of rubber is arranged at a position facing sandwiching the heat releasing body 41. The circuit element 39 is sandwiched between the elastic member 40 and the heat releasing body 41. Accordingly, the circuit element 39 is brought in a close thermo conductive contact with the heat releasing body 41, by an elastic force of the elastic member 40.

The heat releasing body 41 is a metallic member. The heat releasing body 41 is formed by a bottom portion 42 which is substantially parallel to the bottom plate 21 and is in close contact with the circuit element 39, and a side portion 43 which is substantially parallel to the side wall 77*a* of the head holder 20 and which guides the flexible wire member 33 toward the circuit board 23, making an L shape in a side view. The bottom portion 42 and the side portion 43 of the heat releasing body 41 are formed to be long in a direction same as a longitudinal direction (X-axis direction) of the circuit element 39. A fixing hole 41*a* is formed at two locations in the bottom portion 42, and the heat releasing body 41 is fixed to the head holder 20 by inserting the pins 21*b* provided on the bottom plate 21 through the fixing holes 41*a*, and welding.

According to the structure described above, when the circuit element 39 generates heat during the recording operation, the heat generated is transferred to the heat releasing body 41. On the other hand, at the time of the recording operation, by operating the pump 18, the air in the space 50 which is formed on the upper surface side of the bottom plate 21 of the head holder 20 is sucked from the connecting port 52 by the suction force of the pump 18, and the space 50 becomes negatively pressurized. As the space 50 is negatively pressurized, the air around the nozzles 7 is sucked into the space 50 from the gap 29, in other words, the suction port, which is formed in the bottom plate 21. The sucked air further passes from the connecting port 52 to the discharge tube 72, and is guided into the waste liquid tank 71. At this time, the air passing through the space 50 flows through the space 50 making a contact with the circuit element 39 and the heat releasing body 41. In other words, warm air around the circuit element 39 and the heat releasing body 41 is sucked toward the connecting port 52, and is replaced continuously by air which has flowed in from the suction port 29, and the circuit element 39 and the heat releasing body 41 are cooled down. Moreover, when the recording head 3 carries out the recording operation, the ink is jetted from the nozzles 7 toward a paper which is an object subjected to jetting. At this time, fine droplets of ink in the form of mist (ink mist) are generated together with ink droplets which land on the paper. The air sucked into the space 50 from the suction port 29 contains this ink mist. The ink mist is adhered to the circuit element 39 and the heat releasing body 41, and is vaporized by the heat of the circuit element 39 and the heat releasing body 41. Thus an effect of cooling down the circuit element 39 and the heat releasing element 41 is also achieved by the vaporization of the ink mist due to the heat of the circuit element 39 and the heat releasing element 41.

Moreover, according to the first embodiment, since the suction port 29, as shown in FIG. 1A, opens continuously around rows of nozzles 7 (nozzle rows) arranged in the secondary scanning direction (X-axis direction), before the generated ink mist floats in the interior of the apparatus and contaminates the interior of the apparatus by adhering to various members, it is possible to suck the ink mist together with the air around the nozzles 7. In the first embodiment, although the gap 29, in other words, the suction port is open continuously around the nozzles 7, the suction port 29 may not be formed to surround an area around the nozzles 7. When the jetting head unit 2 jets the ink while moving in the main scanning direction (a predetermined direction), the ink mist tends to flow in a side opposite to the movement direction of the jetting head unit 2, which is the main scanning direction, by an air flow which is generated due to the movement of the jetting head unit 2. Consequently, when the suction port 29 opens along the row of nozzles 7 extending in a direction orthogonal to the main scanning direction, in other words, the secondary scanning direction (X-axis direction), on both sides of the main scanning direction with respect to the nozzles 7, it is possible to recover efficiently the ink mist which has flowed by the air flow generated due to the reciprocating movement of the jetting head unit 2. Moreover, in this case, the suction port 29 is not necessarily required to be open continuously in the secondary scanning direction, and may be arranged as the plurality of suction ports 29 along the row of the nozzles 7.

If the ink mist is adhered to members such as the actuator 32, the flexible wire member 33, the circuit element 39, and the circuit board 23, there is a possibility of occurrence of an electric fault. Therefore, it is desirable to apply an electric insulation coating in advance to the members.

A plurality of embodiments in which the first embodiment is applied will be described below. In the description of the embodiments, same reference numerals are used for components which are similar as in the first embodiment, and the description of such components is omitted.

Figure 5:
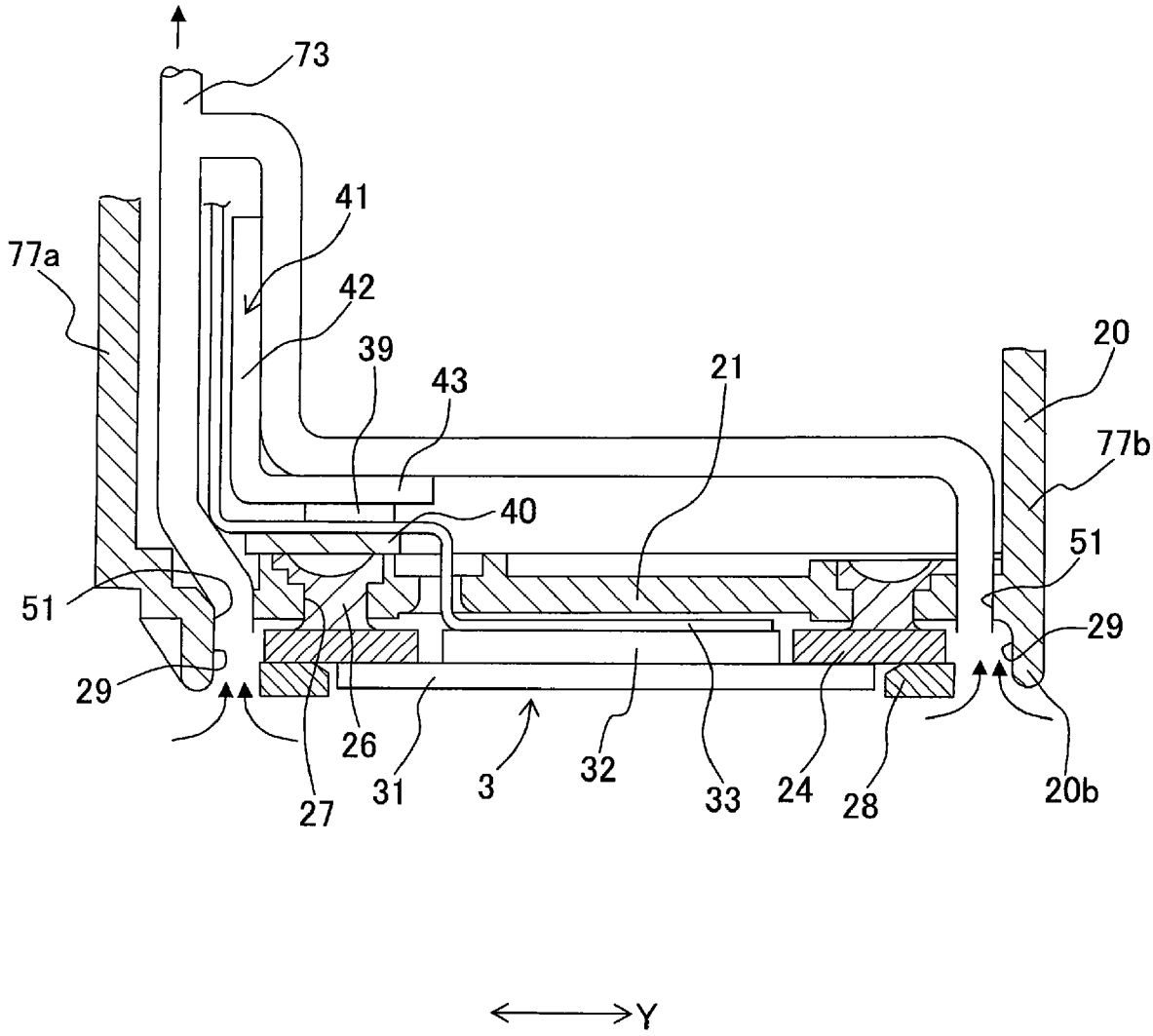
FIG. 5 is a cross-sectional view corresponding to FIG. 3, in a second embodiment.

Firstly, a second embodiment will be described below by using FIG. 5. In FIG. 5, a part of components arranged on the upper surface side of the bottom plate 21 are omitted. In the second embodiment, an open end of the discharge tube 73 is arranged to be open toward a lower surface side of the communicating port 51 provided in the bottom plate 21 of the head holder 20. In other words, from an inserting port (not shown in the diagram) formed in the lid 20*a* or the side wall 77 of the head holder 20, the discharge tube 73 is inserted into an inner side of the head holder 20, and from the upper surface side of the bottom plate 21, the open end of the discharge tube 73 is inserted into the communicating port 51. The discharge tube 73 is branched into a plurality of tubes at the interior of the head holder 20, and communicates with appropriate locations of the gap 29, in other words, the suction port. Moreover, at an inner side of the head holder 20, the discharge tube 73 is drawn to be along an outer surface of the heat releasing body 41.

In this structure, the air and the ink mist around the nozzles 7 are sucked directly into the discharge tube 73 from the suction port 29 by the pump 18, flow inside the discharge tube 73 along the heat releasing body 41, and are discharged to the waste liquid tank 71. Consequently, in the second embodiment, similarly as in the first embodiment, in addition to achieving an effect of cooling the heat releasing body 41 and an effect of removing the ink mist, since the ink mist is sucked directly from the suction port 29 without passing through the space 50 inside the head holder 20, it is possible to prevent the ink mist from adhering to components such as the actuator 32, the flexible wire member 33, the circuit element 39, and the circuit board 23.

Figure 6:
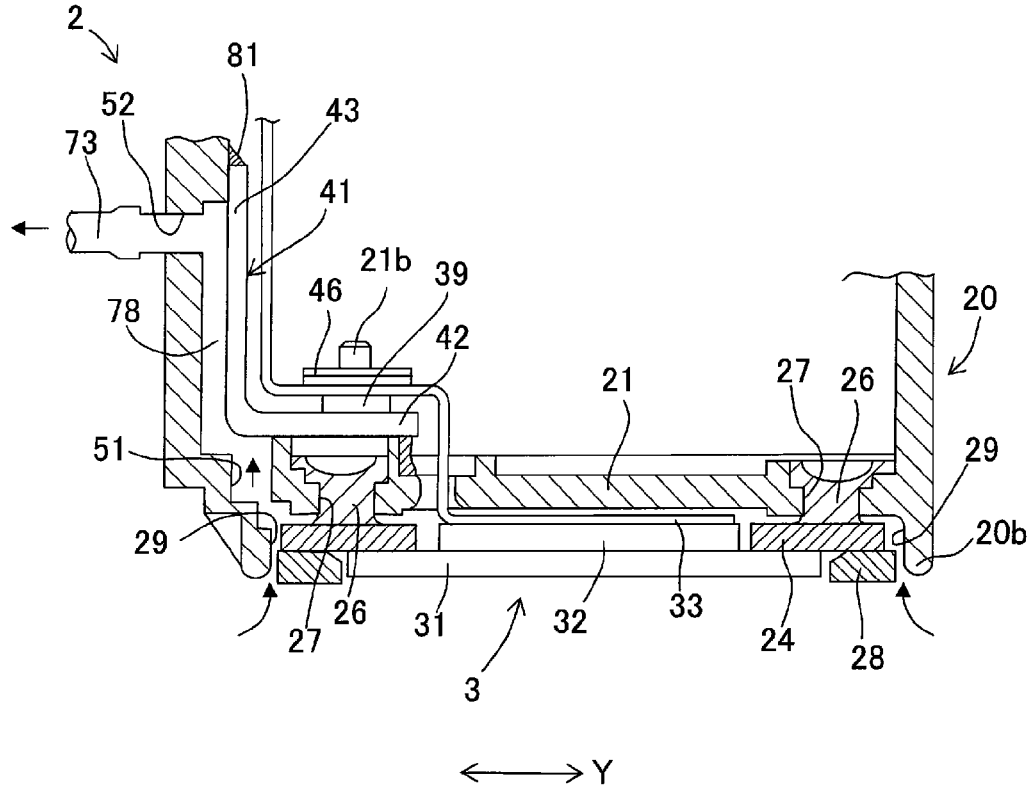
FIG. 6 is a cross-sectional view corresponding to FIG. 3, in a third embodiment.

Next, a third embodiment will be described by using FIG. 6. In FIG. 6, a part of components arranged on the upper surface side of the bottom plate 21 are omitted. In the third embodiment, the heat releasing body 41 which is L-shaped in a side view is fixed to overlap both the bottom plate 21 and the side wall 77*a* of the head holder 20, and a space 78 is formed between the heat releasing body 41 and the head holder 20. The space 78 is formed to be long in a longitudinal direction (X-axis direction) of the heat releasing body 41.

The space 78 communicates with the suction port 29 via the communicating port 51 which is provided near the side wall 77*a* in the bottom plate 21. Moreover, the space 78 communicates with the discharge tube 73 which is connected to the connecting port 52 provided in the side wall 77*a* at a position away from the communicating port 51. As a matter of course, surrounding of the heat releasing body 41 is sealed by a sealing material 81 with respect to the head holder 20 such that air in the space 78 does not leak. In the third embodiment, the circuit element 39 is mounted on a lower surface side of the flexible wire member 33 so as to face the heat releasing body 41 which is fixed to the head holder 20, and a clamping member 46 for pressing the flexible wire member 33 against the heat releasing body 41 is fixed to the pin 21*b*.

In the third embodiment, since the gap 29 as the suction port is formed to be continuous to surround an entire outer circumference of the jetting head 3, even when the communicating port 51 which connects the space 78 and the gap 29 is formed at one location, the air and the ink mist around the jetting head 3 are sucked from the entire circumference of the jetting head 3 by a suction force of the pump 18. Further, air which passes through the space 78 makes a direct and assured contact with the heat releasing body 41, and cools down the heat releasing body 41. Consequently, in the third embodiment, similarly as in the first embodiment, it is possible to obtain the effect of cooling the heat releasing body 41, and the effect of removing the ink mist. Further, since the ink mist is sucked into the discharge tube 73 upon passing through the space 78, it is possible to reduce adhering of the ink mist to the components such as the actuator 32, the flexible wire member 33, the circuit element 39, and the circuit board 23 similarly as in the second embodiment.

Figure 7:
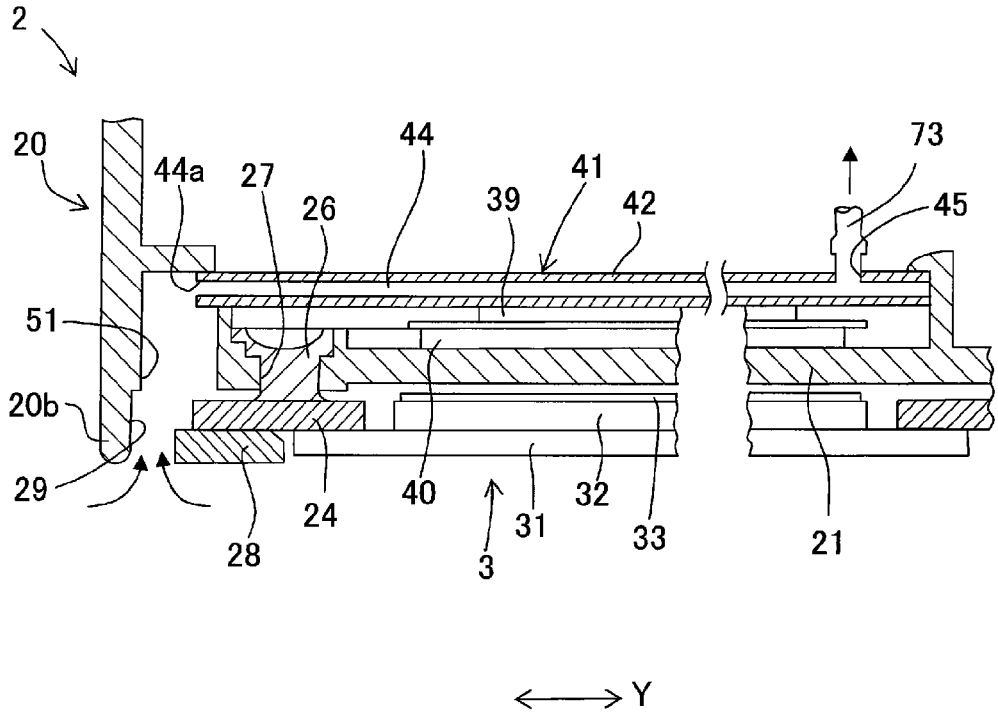
FIG. 7 is a diagram corresponding to a cross-sectional view taken along a line VII-VII in FIG. 2, in a fourth embodiment.

Next, a fourth embodiment will be described by using FIG. 7. In FIG. 7, a part of components arranged on the upper surface side of the bottom plate 21 are omitted. FIG. 7 is a diagram corresponding to a cross-sectional view taken along a line VII-VII in FIG. 2. In the fourth embodiment, a space 44 is formed in the bottom portion 42 of the heat releasing body 41. One end 44*a* of the space 44 is connected to the suction port 29 via the communicating port 51, and the other end of the space 44 is connected to the discharge tube 73 which is connected to a connecting port 45 formed in the bottom portion 42.

In other words, by the suction force of the pump 18, the air and the ink mist around the nozzles 7, upon passing through the suction port 29, flow into the space 44 from one end 44*a* of the heat releasing body 41, and are discharged to the waste liquid tank 71 upon passing through the discharge tube 73. The air which passes through the space 44 makes a direct and assured contact with the heat releasing body 41 at an interior of the heat releasing body 41, and cools down the heat releasing body 41. Consequently, in the fourth embodiment also, similarly as in the first embodiment, it is possible to obtain the effect of cooling the heat releasing body 41, and the effect of removing the ink mist. Further, since the ink mist is sucked into the discharge tube 73 upon passing the space 44 inside the heat releasing body 41, it is possible to reduce adhering of the ink mist to the components such as the actuator 32, the flexible wire member 33, the circuit element 39, and the circuit board 23 similarly as in the second embodiment.

In the embodiments from the first embodiment to the fourth embodiment described above, a case in which the heat generating section in the jetting head unit 2 is the circuit element 39 of the flexible wire member 33 has been described. However, the present invention is also applicable to a case in which some other portion is the heat generating portion, such as a case in which the jetting head generates heat.

Figure 8:
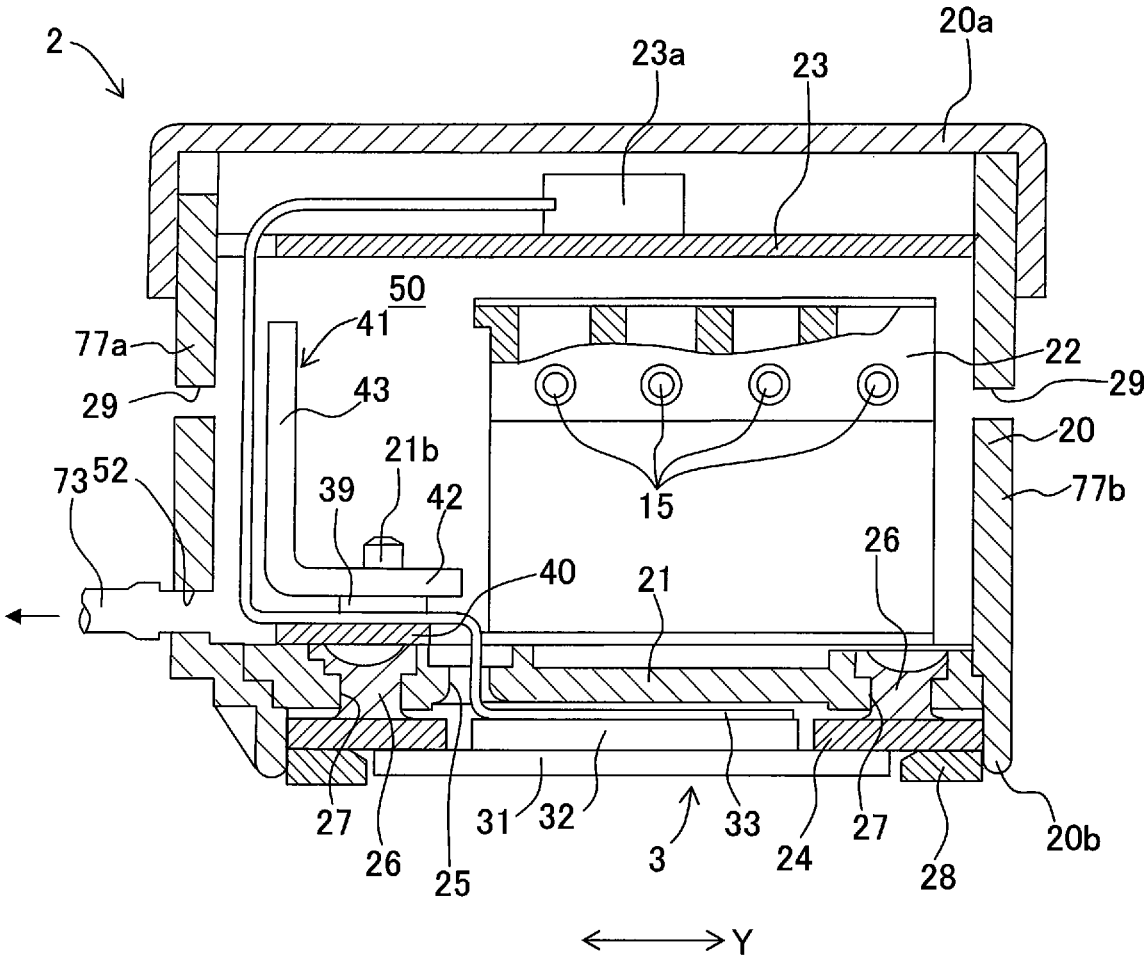
FIG. 8 is a cross-sectional view corresponding to FIG. 3 of a modified embodiment.

Moreover, in the embodiments described above, the suction port 29 in the jetting head unit 2 is opened so as to face the object subjected to jetting, in other words, opened on a bottom surface of the jetting head unit 2. However, a position at which the suction port 29 is opened is not restricted to the bottom surface of the jetting head unit 2. The suction port 29 may be formed to open at the side wall 77*a* and the side wall 77*b* of the head holder 20 as shown in FIG. 8 for example, provided that it is possible to suck, together with the air, the mist generated when the ink is jetted.

Moreover, in the embodiments described above, although the description has been made by exemplifying a recording apparatus as a jetting apparatus which jets an ink, the present invention is also applicable to an apparatus which jets a liquid other than ink. The present invention is applicable to an apparatus which jets a colored liquid for coloring a color filter etc. of a liquid display apparatus, and liquid droplet jetting apparatuses which are used in various fields such as medical treatment and analysis.

What is claimed is:

1. A liquid droplet jetting apparatus which jets a liquid droplet of a liquid, comprising:

a jetting head unit having a nozzle which jets the liquid droplet, a heat generating section in the jetting head unit, and a heat releasing body which releases the heat of the heat generating section;

a suction port which is formed in the jetting head unit, and which is open in the vicinity of the nozzle; and a suction device configured to suck air around the nozzle from the suction port through an air flowing path, wherein the heat releasing body is positioned in the air flowing path of the air sucked from the suction port.

2. The liquid droplet jetting apparatus according to claim 1, wherein the suction port is continuously open around the nozzle.

3. The liquid droplet jetting apparatus according to claim 1, further comprising:

a waste liquid tank which stores the liquid discharged from the jetting head unit for restoring a jetting function of the jetting head unit; and a conduit which connects the jetting head unit and the waste liquid tank via the suction device, and which guides the air, sucked from the suction port, to the waste liquid tank.

4. The liquid droplet jetting apparatus according to claim 3, further comprising a maintenance unit having the waste liquid tank, a cap which covers the nozzle, a suction pump which sucks the liquid from the nozzle, and a tube which connects the cap and the waste liquid tank via the suction pump.

5. The liquid droplet jetting apparatus according to claim 4, wherein the suction device uses the suction pump to suck the air around the nozzle from the suction port.

6. The liquid droplet jetting apparatus according to claim 1, wherein the jetting head unit is provided with a jetting head having the nozzle which jets the liquid droplet, a wire member on which a circuit element for driving the jetting head is mounted, and a heat releasing body which releases heat of the circuit element; and the heat releasing body is arranged to be in contact with the air sucked from the suction port.

7. The liquid droplet jetting apparatus according to claim 6, wherein the heat generating section is the circuit element; and the heat releasing body is in a thermally conductive contact with the circuit element.

8. The liquid droplet jetting apparatus according to claim 7, wherein an insulation treatment is applied to the circuit element and a surface of the wire member.

9. The liquid droplet jetting apparatus according to claim 3, wherein the jetting head unit is provided to be movable in a predetermined direction along an object onto which the liquid droplet is to be jetted; the waste liquid tank is supported by a body of the liquid droplet jetting apparatus, the body movably supporting the jetting head unit; and at least a part of the conduit is a flexible tube.

10. The liquid droplet jetting apparatus according to claim 9, wherein the nozzle is formed as a plurality of nozzles arranged in an orthogonal direction orthogonal to the predetermined direction; the plurality of nozzles form a nozzle row; and the suction port is formed to extend in the orthogonal direction, with respect to the nozzle row, on both sides of the predetermined direction.

11. The liquid droplet jetting apparatus according to claim 9, wherein the nozzle is formed as a plurality of nozzles arranged in an orthogonal direction orthogonal to the predetermined direction; the plurality of nozzles form a nozzle row; and the suction port is formed as a plurality of suction ports arranged in the orthogonal direction, with respect to the nozzle row, on both sides of the predetermined direction.

12. The liquid droplet jetting apparatus according to claim 9, wherein a cartridge, which accommodates the liquid to be supplied to the jetting head unit, is supported by the body of the liquid droplet jetting apparatus; the jetting head unit and the cartridge are connected by a liquid supply tube which is a flexible tube; and the flexible tube is arranged substantially in parallel to the liquid supply tube.

13. The liquid droplet jetting apparatus according to claim 8, wherein the jetting head unit is further provided with a casing which supports the jetting head and the heat releasing body; the suction port is formed in the casing; and the suction device negatively pressurizes a space inside the casing including a surrounding of the heat releasing body to suck, from the suction port, the air outside the casing.

14. The liquid droplet jetting apparatus according to claim 7, further comprising a conduit having one end formed in the vicinity of the nozzle as the suction port, and the other end connected to the suction device, wherein a part of the conduit is in thermally conductive contact with the heat releasing body.

15. The liquid droplet jetting apparatus according to claim 7, wherein the jetting head unit is further provided with a casing which supports the jetting head and the heat releasing body; the suction port is formed in the casing; a space is defined between the heat releasing body and a wall of the casing, the space being connected to the suction port; and the air is sucked while contacting the heat releasing body.

16. The liquid droplet jetting apparatus according to claim 7, wherein a space is defined inside the heat releasing body, one end of the space communicating with the suction port and the other end of the space communicating with the suction device.

17. A liquid droplet jetting apparatus which jets a liquid droplet of a liquid, comprising:

a jetting head unit having a nozzle which jets the liquid droplet, and which is movable in a predetermined direction;

a suction port which is formed in the jetting head unit, and which is open in the vicinity of the nozzle; and a suction device which sucks, from the suction port, mist generated when the nozzle jets the liquid droplet, wherein the suction port is continuously open and surrounds the nozzle.

18. The liquid droplet jetting apparatus according to claim 17, wherein the nozzle is formed as a plurality of nozzles arranged in an orthogonal direction orthogonal to the predetermined direction; the plurality of nozzles form a nozzle row; and the suction port is formed to extend in the orthogonal direction, with respect to the nozzle row, on both sides of the predetermined direction.

19. The liquid droplet jetting apparatus according to claim 17, wherein the nozzle is formed as a plurality of nozzles arranged in an orthogonal direction orthogonal to the predetermined direction; the plurality of nozzles form a nozzle row; and the suction port is formed as a plurality of suction ports arranged in the orthogonal direction, with respect to the nozzle row, on both sides of the predetermined direction.

* * * * *